United States Patent [19]

Roark

[11] 4,059,073

[45] Nov. 22, 1977

[54] HEAD GATE

[76] Inventor: Thomas A. Roark, 221 N. Alexander St., Clay Center, Nebr. 68933

[21] Appl. No.: 739,229

[22] Filed: Nov. 5, 1976

[51] Int. Cl.[2] ..... A61D 3/00

[52] U.S. Cl. ..... 119/98

[58] Field of Search ..... 119/98, 99, 103, 147

[56] References Cited

U.S. PATENT DOCUMENTS 186,945 2/1877 Ogborn ..... 119/99

1,271,343 7/1918 Manning ..... 119/99

*Primary Examiner*—Hugh R. Chamblee

*Attorney, Agent, or Firm*—Henderson, Strom & Sturm

[57] ABSTRACT

A multi-action head gate is disclosed which, by actuation of a single element, selectively opens a passageway or closes it about the neck of an animal for secure engagement therewith. The engagement apparatus consists primarily of a vertically movable ear block and a pair of opposing pivotable jaw locks, all three of which simultaneously move to engage or release the animal.

10 Claims, 4 Drawing Figures

HEAD GATE

BACKGROUND OF THE INVENTION

Restraining devices are frequently used in connection with animal husbandry activities, especially those which deal with the treatment of livestock. The most common restraining devices known in the prior art are used in connection with a doorway, a gate, or a chute and secure the head of an animal. Such devices are commonly referred to as head gates and generally require manual operation by one person while another person urges the animal into the engagement area. Also, several of the prior art devices employ a self-locking structure which is operated by the movement of the animal into the device.

Typical of the prior art head gates is shown in U.S. Pat. No. 3,513,812. The device shown therein is a self locking livestock head gate consisting of a stanchion having closely spaced head locking members pivoted for forward, tilting, converging movement caused by movement of an animal. Various other elements of the structure prevent the animal from withdrawing therefrom once engagement is obtained.

U.S. Pat. No. 3,623,456 shows another head gate which employs a pair of animal neck engaging members supported on a main frame for simultaneous vertical movement and a lateral movement toward and away from each other within the transverse confines of a main frame.

SUMMARY OF THE INVENTION

It is an object of this invention to provide an improved head gate which is durable of construction, inexpensive of manufacture and extremely effective in use.

It is another object of this invention to provide a head gate which may be operated by a single individual.

It is another object of this invention to provide a head gate which locks in position and cannot be jarred or otherwise accidentally released.

It is a further object of this invention to provide a head gate which holds and restrains animals without presenting danger to either the animal or the operator.

It is a further object of this invention to provide a head gate which will be suitably restrain animals of varying size and weight.

It is a still further object of this invention to provide a head gate which is readily transportable and which may be quickly and easily disposed in operating position within a chute, doorway, or gate.

It is an even still further object of this invention to provide a head gate which is particularly well suited for restraining hogs.

These, and other objects are accomplished according to the instant invention by providing a multi-action head gate which, by actuation of a single element, selectively opens a passageway or closes it about the neck of an animal for secure engagement therewith. The engagement apparatus consists primarily of a vertically movable ear block and a pair of opposing pivotable jaw locks, all three of which simultaneously move to engage or release the animal.

BRIEF DESCRIPTION OF THE DRAWINGS

The advantages of this invention will become apparent upon consideration of the following detailed disclosure of the invention, especially when it is taken in conjunction with the accompanying drawings wherein.

DESCRIPTION OF THE PREFERRED EMBODIMENTS

Figure 2:
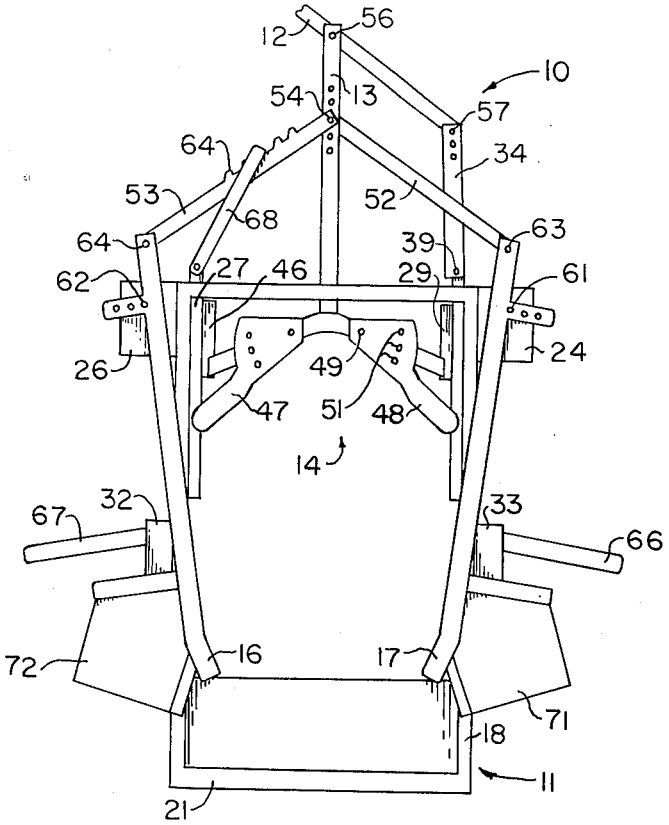
FIG. 2 is a front plan view of the head gate of the instant invention showing the engagement members in the full open position.
Figure 1:
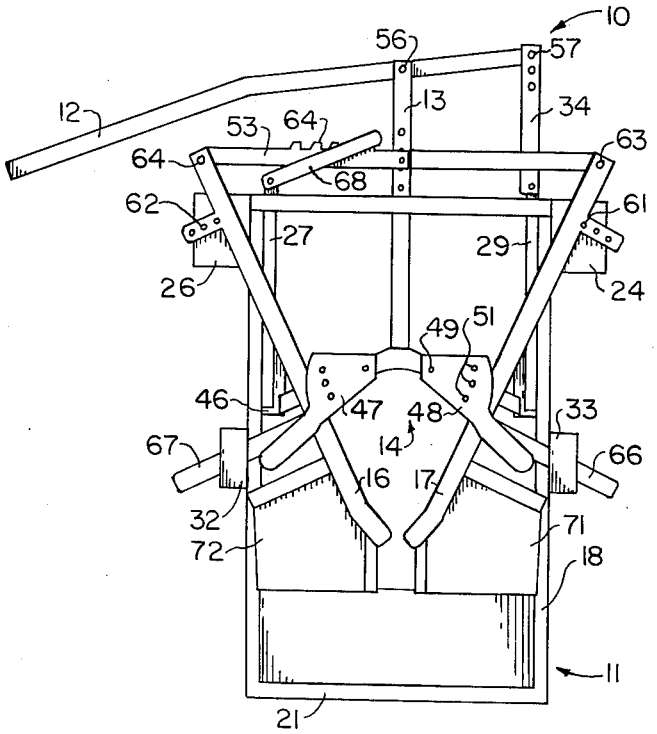
FIG. 1 is a front plan view of the head gate of the instant invention showing the engagement members in a full closed position.

Referring now to FIG. 1, the head gate of the instant invention can be seen in its full closed position. The primary elements of the head gate 10 include a main frame 11, an actuating handle 12, a vertical slide member 13, an ear block 14, and a pair of opposing jaw locks 16 and 17. The apparatus to be described below restrains an animal through the simultaneous engagement of its upper and lower neck areas by the ear block and jaw locks. FIG. 1 shows the apparatus in its closed position, as it would appear during the holding operation. FIG. 2, on the other hand, shows the head gate in the full open position after release of the animal.

Figure 3:
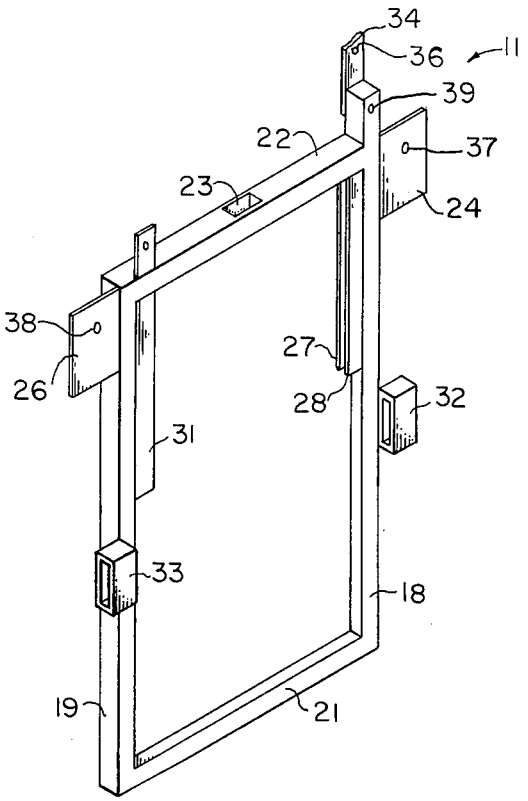
FIG. 3 is a perspective view of the main frame members of the head gate of the instant invention.

The apparatus description is best begun with FIG. 3 which shows the structural elements of main frame 11. A pair of spaced apart upright side members 18 and 19 are connected by a rigid base member 21 and a horizontal main frame member 22. The horizontal main frame member 22 has a vertical slot 23 therethrough, the purpose of which will be discussed below. Each of these main frame members may be constructed of any suitable material, but square tubing has been found to be the most satisfactory.

Affixed to and extending away from each of the vertical main frame members 18 and 19 are extension plates 24 and 26. These plates each include a hole therethrough 37 and 38, respectively, which, as will be discussed below, serve as a pivot point for the jaw locks. Additionally, extending inwardly from each of the vertical main frame members 18 and 19 are a pair of spaced apart plates 27 and 28, and 29 and 31, which serve as guides for the ear block stabilizer plates. Finally, extending forwardly from each of the vertical main frame members are jaw block stabilizers guides 32 and 33. These stabilizer guides each comprise a small frame which serves as a guide for the jaw block stabilizer arm.

Finally, extending upwardly from the vertical frame member 18 is an extension pivot arm 34 which is pivotable connected to member 18 by a pin 39. Extension pivot arm 34 further includes a plurality of holes therethrough 36 for adjustable engagement with the actuation handle 12.

Figure 4:
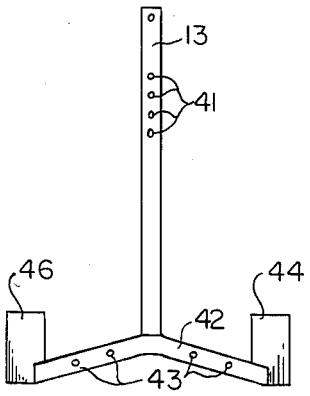
FIG. 4 is a front plan view of the vertical slide member and ear block stabilizer arm of the instant invention.

Understanding of the overall assembly of the device will be enhanced by a brief referral to FIG. 4. Shown therein is the structural relationship between various of the elements which move vertically during the engagement and disengagement of the head gate. Vertical slide member 13 is shown to contain a number of holes 41 therethrough which, as will be seen below, allow adjustment of the device to accommodate animals of varing size. A somewhat horizontal ear block stabilizer arm 42 is affixed to the vertical slide member and also contains holes therethrough to provide adjustment. Affixed to the ends of the ear block stabilizing arm are ear block stabilizer plates 44 and 46. These plates move vertically between the plates 27 and 28 and 29 and 31, respectively, to add stability to the apparatus and prevent the animal from moving forwardly or rearwardly once engagement is made.

Referring once again to FIG. 1, the overall assembly of the apparatus will now be described.

A pair of ear blocks 47 and 48 are affixed to the ear block stabilizer arm 42 and travel vertically therewith during the engagement and disengagement steps. Each of the blocks 47 and 48 are curved to conform to the upper neck and shoulder area of the animal to be engaged thereby. Also, each of the ear blocks are movably, or selectively movably, affixed to the stabilizer arm by a pin 49 and an arrangement of holes 51 through which a pin may be inserted, into holes 43 in stabilizer arm 42 to adjust the spacing between the blocks 47 and 48. The vertical slide member 13 is positioned through the slot 23 in horizontal main frame member 22 and is hingedly connected to actuation handle 12 by a pin 56. The main pivot of actuation handle 12 is on extension pivot arm 34 and is accomplished by the insertion of a pin 57 through the two elements.

Each of the jaw locks 16 and 17 include an elongate arm member terminating in the lower portion of the head gate with a curved surface which is adapted to engage the lower neck portion of the animal being restrained. The opposite end of the jaw lock is pivoted as at 61 and 62 to the extension plates, and extends therebeyond for pivotable engagement with the pivot arms 52 and 53, as at points 63 and 64, respectively. Each of the jaw locks further includes a stabilizer arm 66 and 67 which extend through stabilizer guides 33 and 32, respectively. The simultaneous operation of the engagement elements is ensured by pivot arms 52 and 53 which are, respectively, pivotally affixed to jaw locks 17 and 16 at pivot points 63 and 64, and vertical slide member 13 at pivot point 54.

In operation, the engagement elements are positioned such that the opening is proximate midway between full open and full closed. The animal is then enticed to position his his head within the opening and the actuation handle is pulled downwardly. This action causes the vertical slide member 13 to engage the back of the animal's head or neck with the ear blocks 47 and 48. Simultaneously, with this downward movement, the pivot arms 52 and 53 are moved outwardly, thus causing the jaw locks 16 and 17 to pivot about points 61 and 62 and engage the opposing sides of the animal's lower neck. When it is desired to release the animal, the actuation handle 12 is raised, thus causing the ear blocks to move in a vertical direction away from engagement and the jaw locks 16 and 17 to pivot outwardly.

As mentioned above, various of the elements may be adjusted to accommodate animals of different sizes. For instance, a very large animal would require adjustment of the pivot point 54 downward relative to slide member 13, clockwise adjustment of ear block 47, counterclockwise adjustment of ear block 48, and outward adjustment of pivot points 61 and 62. The reverse would be true for a smaller animal.

It will be understood that various changes in the details, materials, steps, and arrangements of parts which have been described and illustrated in order to explain the nature of the invention, will occur to and may be made by those skilled in the art upon a reading of the disclosure within the principles and scope of the invention.

For example, the base plate 21, shown in FIGS. 1-3, can under certain circumstances, be a very advantageous addition. As shown in these figures, the base plate functions as a temporary barrier, i.e., slows the forward motion of the animal and simplifies the engagement step by momentarily stopping the animal in proper position for engagement. The plate also protects the animal's feet from inadvertent injury by an operator standing in front of the gate working on the restrained animal.

Also, for example, it may be found advantageous to affix block plates 71 and 72 to the jaw locks to more fully block the area between the jaw locks and the base plate 21. Obviously, this would prevent the animal from extending a leg through the opening and injuring himself and/or the operator.

Finally, superior operating characteristics have been obtained by the inclusion of a mechanism for locking the device.

I claim:

1. A head gate comprising:

a. an upright main frame having a pair of transversely spaced side members and a horizontal member affixed at its ends to said side members;

b. a vertical slide member vertically slidably engaged with said horizontal member, said slide member having a first end below said horizontal member and a second end thereabove;

c. an ear block affixed to, and depending from, said first end of said vertical slide member, said ear block including a curved surface for engaging the back of the neck of an animal;

d. a pair of elongate jaw locks pivotally connected, respectively, to said side members such that the lower ends thereof are between said side members;

e. a pair of pivot arms pivotally connected, respectively, to said elongate jaw locks, above the pivot point thereof with said side members, and said vertical slide member, above said horizontal member; and f. means for moving said vertical slide member in a vertical direction whereby said ear block and jaw locks may be selectively moved together to substantially close the opening therebetween or moved apart to increase the opening.

2. The head gate of claim 1 wherein said horizontal member has a vertical slot therethrough within which said vertical slide member is positoned for vertical sliding movement.

3. The head gate of claim 2 wherein said spaced side members include first guides facing each other; and said ear block includes substantially horizontal elements projecting from each side thereof and engaging said first guides on each said spaced side members.

4. The head gate of claim 3 wherein said means for moving said vertical slide member in a vertical direction comprises an elongate actuation handle pivotally connected on one end to one of said side members and extending generally toward the other side member, said actuation handle further pivotally connected to said vertical slide member adjacent said second end thereof.

5. The head gate of claim 4 wherein said side members each further include second guides engaged with said jaw locks.

6. The head gate of claim 5 further including lock means for fixing said actuation handle in a selective location.

7. The head gate of claim 6 wherein said lock means comprises means for fixing one of said pivot arms in a selectable vertical position.

8. The head gate of claim 5 wherein said side members each include an extension plate affixed thereto and protruding outwardly therefrom away from the other side member, each said extension plate having a hole therethrough to which said jaw locks are, respectively, pivotally attached.

9. The head gate of claim 8 wherein said jaw locks each includes a block plate affixed thereto adjacent the end thereof remote said pivot attachment with said extension plate, said block plates positioned to close, at least partially, the open area between said side members when said jaw locks are pivoted toward each other.

10. The head gate of claim 9 further including a lock means for fixing said actuation handle in a selective location.

* * * * *